US012583026B2

(12) United States Patent
Itoi et al.

(10) Patent No.: US 12,583,026 B2
(45) Date of Patent: Mar. 24, 2026

(54) DIE AND HOT PRESS FORMING APPARATUS

(71) Applicant: G-TEKT CORPORATION, Saitama (JP)

(72) Inventors: Hiroki Itoi, Tokyo (JP); Katsuhito Amagasa, Gunma (JP)

(73) Assignee: G-TEKT CORPORATION, Saitama (JP)

( * ) Notice: Subject to any disclaimer, the term of this patent is extended or adjusted under 35 U.S.C. 154(b) by 392 days.

(21) Appl. No.: 18/042,280

(22) PCT Filed: Nov. 20, 2020

(86) PCT No.: PCT/JP2020/043419

§ 371 (c)(1),
(2) Date: Feb. 20, 2023

(87) PCT Pub. No.: WO2022/038798

PCT Pub. Date: Feb. 24, 2022

(65) Prior Publication Data

US 2023/0311191 A1 Oct. 5, 2023

(30) Foreign Application Priority Data

Aug. 21, 2020 (JP) ..... 2020-140392

(51) Int. Cl.
*B21D 37/16* (2006.01)
*B21D 22/20* (2006.01)

(52) U.S. Cl.
CPC ..... *B21D 37/16* (2013.01); *B21D 22/20* (2013.01)

(58) Field of Classification Search
CPC ..... B21D 37/16; B21D 22/208; B21D 22/20; B21D 22/022
See application file for complete search history.

(56) References Cited

U.S. PATENT DOCUMENTS

2007/0017272 A1 1/2007 Kurisu et al.
2014/0069162 A1* 3/2014 Fukuchi ..... B21D 37/16 72/342.2

(Continued)

FOREIGN PATENT DOCUMENTS

JP 2002-331317 A 11/2002
JP 2005-169394 A 6/2005

(Continued)

OTHER PUBLICATIONS

International Preliminary Report on Patentability received for PCT Patent Application No. PCT/JP2020/043419, mailed on Mar. 2, 2023, 13 pages (7 pages of English Translation and 6 pages of Original Document).

(Continued)

*Primary Examiner* — Teresa M Ekiert
(74) *Attorney, Agent, or Firm* — WOMBLE BOND DICKINSON (US) LLP

(57) ABSTRACT

A die press-forms a tailor welded blank (12A) in a heated state, the tailor welded blank being formed by welding a first plate portion (34) made of a first metal plate material and a second plate portion (35) made of a second metal plate material thicker than the first metal plate material while making the first plate portion and the second plate portion abut against each other. The die includes a refrigerant passage through which a refrigerant flows, and at least one refrigerant ejection path (64) having one end connected to the refrigerant passage and the other end opening to a forming surface of the die (lower die 13). The die includes a first forming surface (51), and a second forming surface (52), farther apart from a forming surface of another die than the first forming surface (51), for forming a step (53) together with the first forming surface (51). The other end of the at least one refrigerant ejection path (64) opens near the step (53) on the second forming surface (52) between the (Continued)

first forming surface (51) and the second forming surface (52). It is possible to provide a die for hot press forming, which can perform quenching even for the step portion of the metal plate material and increase hardness.

4 Claims, 11 Drawing Sheets

(56) References Cited

U.S. PATENT DOCUMENTS

| | | | | |
|---|---|---|---|---|
| 2014/0123721 | A1* | 5/2014 | Ishii | B21D 37/16 72/347 |
| 2016/0167101 | A1* | 6/2016 | Fukuchi | B21D 22/208 72/342.4 |
| 2019/0100816 | A1* | 4/2019 | Seki | B21D 22/022 |

FOREIGN PATENT DOCUMENTS

| | | | |
|---|---|---|---|
| JP | 2005-178695 | A | 7/2005 |
| JP | 2010-036222 | A | 2/2010 |
| JP | 2017-140636 | A | 8/2017 |
| JP | 2018-012115 | A | 1/2018 |
| JP | 6748255 | B1 | 8/2020 |

OTHER PUBLICATIONS

International Search Report and Written Opinion received for PCT Patent Application No. PCT/JP2020/043419, mailed on Dec. 28, 2020, 16 pages (8 pages of English Translation and 8 pages of Original Document).

Notice of Reasons for Refusal received for Japanese Patent Application No. 2020-140392, mailed on Apr. 26, 2022, 10 pages (6 pages of English Translation and 4 pages of Original Document).

* cited by examiner

DIE AND HOT PRESS FORMING APPARATUS

TECHNICAL FIELD

The present invention relates to a die used to form a metal plate material including a plurality of plate portions with different thicknesses while performing quenching, and a hot press forming apparatus.

BACKGROUND ART

As a technique for forming body frame components of a vehicle, a hot stamping method that is one of hot press forming methods is known. The hot stamping method is a method of putting a metal plate material heated to a high temperature into a hot press forming apparatus, performing press forming for the metal plate material and quenching at the same time. A conventional hot press forming apparatus used to perform the hot stamping method of this type is described in, for example, patent literature 1.

The hot press forming apparatus disclosed in patent literature 1 includes a cooling device configured to cool a die for forming to keep the temperature of the die low.

As a metal plate material used for press forming, a tailor welded blank formed by a plurality of plate materials with different thicknesses can be used as described in, for example, patent literature 2. The tailor welded blank is formed by welding a plurality of plate materials that are made of a metal and have different thicknesses while making these abut against each other. A step portion derived from the different thicknesses of the plate materials is formed on the obverse surface or the reverse surface of a formed product formed using the metal plate material of this type as a material.

RELATED ART LITERATURE

Patent Literature

Patent Literature 1: Japanese Patent Laid-Open No. 2005-169394

Patent Literature 2: Japanese Patent Laid-Open No. 2010-36222

DISCLOSURE OF INVENTION

Problem to be Solved by the Invention

In a formed product formed by the hot stamping method using a metal plate material formed by a plurality of plate materials with different thicknesses, the hardness is low in each step portion that is the boundary between the plate materials. It is considered that the hardness becomes low because cooling by the die is insufficient, and quenching cannot sufficiently be executed. The reason why cooling is insufficient will be described here with reference to FIG. 22.

FIG. 22 shows a state in which a metal plate material 3 is formed by a pair of dies 1 and 2 for conventional hot press forming. The pair of dies 1 and 2 are formed by the lower die 1 and the upper die 2. The lower die 1 and the upper die 2 are cooled to a predetermined temperature by a cooling device (not shown).

The metal plate material 3 is formed by welding a first plate portion 3*a* made of a plate material made of a metal and having a relatively small thickness and a second plate portion 3*b* made of a plate material made of a metal and having a relatively large thickness while making these abut against each other.

The upper surface of the metal plate material 3, that is, the surface formed by the upper die 2 is formed flat. On the lower surface of the metal plate material 3, that is, the surface formed by the lower die 1, a step 4 is formed by the first plate portion 3*a* and the second plate portion 3*b*. The step 4 includes a first step surface 3*c* formed by the end face of the second plate portion 3*b*.

The lower die 1 includes a first forming surface 1*a* that forms the first plate portion 3*a*, and a second forming surface 1*b* that forms the second plate portion 3*b*. The second forming surface 1*b* is formed to be farther apart from a forming surface 2*a* of the upper die 2 than the first forming surface 1*a*, and forms a step 5 together with the first forming surface 1*a*. The step 5 includes a second step surface 1*c* extending in the thickness direction of the first plate portion 3*a*. The second forming surface 1*b* is lower than the first forming surface 1*a* by a height corresponding to the thickness difference between the first plate portion 3*a* and the second plate portion 3*b*.

The second step surface 1*c* is located apart from the first step surface 3*c* that is the boundary between the first plate portion 3*a* and the second plate portion 3*b* by a predetermined distance to the side of the first plate portion 3*a*. For this reason, a space S having a predetermined width in a direction along the first forming surface 1*a* (the left-and-right direction in FIG. 22) is formed between the first step surface 3*c* and the second step surface 1*c*. The space S will simply be referred to as the die releasing space S hereinafter. The die releasing space S is formed because a tolerance exists between the lower die 1 and the metal plate material 3, and the position of the boundary between the first forming surface 1*a* and the second forming surface 1*b* is not always constant with respect to the position of the boundary between the first plate portion 3*a* and the second plate portion 3*b*. That is, the die releasing space S is formed to prevent the first forming surface 1*a* formed on the lower die 1 to be relatively high from hitting the relatively thick second plate portion 3*b* of the metal plate material 3.

A portion of the first plate portion 3*a* exposed to the die releasing space S is the above-described step portion of the formed product. Since the step portion is apart from the lower die 1 and is difficult to cool, quenching is insufficient, and the hardness is low.

It is an object of the present invention to provide a die for hot press forming, which can perform quenching even for the step portion of a metal plate material and increase hardness, and a hot press forming apparatus.

Means of Solution to the Problem

In order to achieve the object, according to the present invention, there is provided a die for press-forming a tailor welded blank in a heated state, the tailor welded blank being formed by welding a first plate portion made of a first metal plate material and a second plate portion made of a second metal plate material thicker than the first metal plate material while making the first plate portion and the second plate portion abut against each other, comprising a refrigerant passage through which a refrigerant flows, at least one refrigerant ejection path having one end connected to the refrigerant passage and the other end opening to a forming surface of the die, a first forming surface for forming the first plate portion, and a second forming surface, farther apart from a forming surface of another die than the first forming surface, for forming a step together with the first forming surface and form the second plate portion, wherein the other end of the at least one refrigerant ejection path opens to a space formed near the step formed on the second forming surface between the first forming surface and the second forming surface, the space being sandwiched between the first plate portion and the second forming surface.

According to the present invention, there is provided a die for press-forming a tailor rolled blank in a heated state, the tailor rolled blank being a metal plate material obtained by integrally forming a first plate portion and a second plate portion thicker than the first plate portion, comprising a refrigerant passage through which a refrigerant flows, at least one refrigerant ejection path having one end connected to the refrigerant passage and the other end opening to a forming surface of the die, a first forming surface for forming the first plate portion, and a second forming surface, farther apart from a forming surface of another die than the first forming surface, for forming a step together with the first forming surface and form the second plate portion, wherein the other end of the at least one refrigerant ejection path opens to a space formed near the step formed on the second forming surface between the first forming surface and the second forming surface, the space being sandwiched between the first plate portion and the second forming surface.

According to the present invention, there is provided a die for press-forming a patched blank in a heated state, the patched blank including a first plate portion made of a first metal plate material and a second plate portion made by overlaying and welding, on the first metal plate material, a second metal plate material different from the first metal plate material, comprising a refrigerant passage through which a refrigerant flows, at least one refrigerant ejection path having one end connected to the refrigerant passage and the other end opening to a forming surface of the die, a first forming surface for forming the first plate portion, and a second forming surface, farther apart from a forming surface of another die than the first forming surface, for forming a step together with the first forming surface and come into contact with the second metal plate material to form the second plate portion, wherein the other end of the at least one refrigerant ejection path opens to a space formed near the step formed on the second forming surface between the first forming surface and the second forming surface, the space being sandwiched between the first plate portion and the second forming surface.

According to the present invention, there is provided a hot press forming apparatus comprising a pair of dies for press-forming a heated metal plate material, and a cooling device configured to supply a refrigerant to at least one die of the pair of dies, wherein the die to which the refrigerant is supplied is the die of the above-described invention, and the refrigerant is supplied from the cooling device to a refrigerant passage.

Effect of the Invention

In the die and the hot press forming apparatus according to the present invention, in the space formed between the metal plate material and the die at the time of forming, the other end of the refrigerant ejection path opens near the step on the second forming surface of the die between the first forming surface and the second forming surface. The refrigerant is supplied from the refrigerant ejection path to the space at the time of forming, and the step portion of the metal plate material exposed to the space can be cooled by the refrigerant.

For this reason, when press-forming the heated metal plate material, quenching is performed even for the step portion of the metal plate material. Hence, according to the present invention, it is possible to provide a die for hot press forming, which can perform quenching even for the step portion of the metal plate material and increase hardness, and a hot press forming apparatus.

BEST MODE FOR CARRYING OUT THE INVENTION

First Embodiment

An embodiment of a die and a hot press forming apparatus according to the present invention will now be described in detail with reference to FIGS. 1 to 11.

Figure 1:
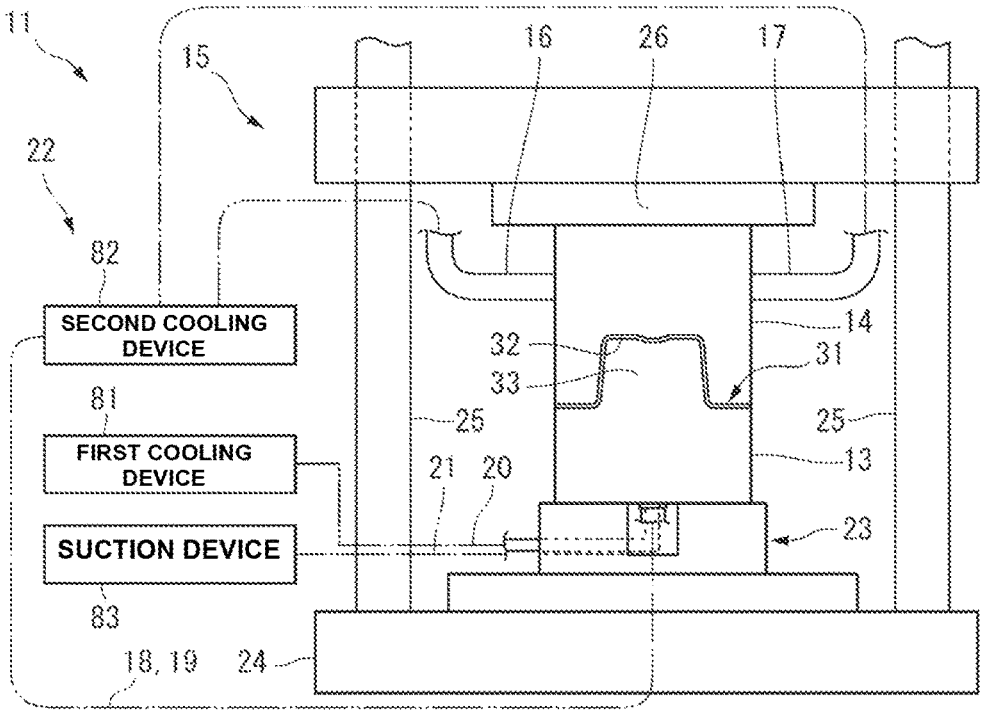
FIG. 1 is a front view showing the configuration of a hot press forming apparatus including a die according to the present invention.

A hot press forming apparatus 11 shown in FIG. 1 forms a metal plate material 12 (see FIG. 2) by a hot stamping method, and is formed by a forming unit 15 including a pair of dies 13 and 14, and a cooling unit 22 connected to the dies 13 and 14 via a plurality of pipes 16 to 21.

In the following description of the configuration of the hot press forming apparatus 11, the near side of the sheet surface of FIG. 1 will be defined as a front side, and the back side of the sheet surface of FIG. 1 will be defined as a rear side for the descriptive convenience. In addition, when the hot press forming apparatus 11 shown in FIG. 1 is viewed from the front side, the upper side will be defined as the upper side of the hot press forming apparatus 11, and the right side will be defined as the right side of the hot press forming apparatus 11.

The pair of dies 13 and 14 are the lower die 13 and the upper die 14. The lower die 13 is attached to a base 24 of the forming unit 15 via a lower die holder 23. A plurality of guide rods 25 extending in the vertical direction stand on the base 24. The upper die 14 is attached to an upper die holder 26. The upper die holder 26 is supported by the guide rods 25 to be movable in the vertical direction. Also, the upper die holder 26 is connected to a pressurizing device (not shown) and is driven by the pressurizing device and thus moves in the vertical direction. Along with a vertical movement of the upper die holder 26, the upper die 14 attached to the upper die holder 26 moves in the vertical direction between a forming position shown in FIG. 1 and a retreat position shown in FIG. 2.

As shown in FIG. 1, the lower die 13 and the upper die 14 form a formed product 31 having a predetermined shape and are formed such that a projecting portion 33 of the lower die 13 is fitted in a concave portion 32 of the upper die 14. The formed product 31 is formed into a predetermined shape using the metal plate material 12 (see FIG. 2) as a material.

Figure 3:
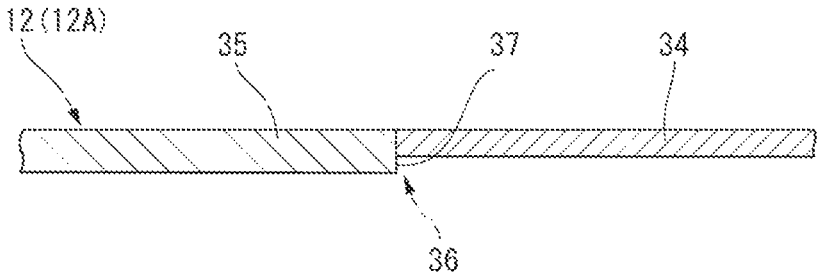
FIG. 3 is an enlarged sectional view showing the step portion of a tailor welded blank.

The metal plate material 12 used in this embodiment is formed by a first plate portion 34 made of a first metal plate material and a second plate portion 35 made of a second metal plate material thicker than the first metal plate material, as shown in FIG. 3. The metal plate material 12 is called a tailor welded blank. The metal plate material 12 formed by the first plate portion 34 and the second plate portion 35 will be referred to as a tailor welded blank 12A hereinafter. The first plate portion 34 and the second plate portion 35 of the tailor welded blank 12A are welded in a state in which their end faces abut against each other. In this embodiment, the upper surface of the metal plate material 12, that is, the surface that comes into contact with the upper die 14 at the time of forming is formed flat. On the lower surface of the metal plate material 12, that is, the surface that comes into contact with the lower die 13 at the time of forming, a step 36 located at the boundary between the first plate portion 34 and the second plate portion 35 is formed. The step 36 includes a first step surface 37 formed by the end face of the second plate portion 35.

The thickness of the first plate portion 34 is not less than 0.8 mm to not more than 2.9 mm. The thickness of the second plate portion 35 is more than 0.8 mm to not more than 5.8 mm. The thickness of the second plate portion 35 is equal to or more than the thickness of the first plate portion 34. The thickness difference between the first plate portion 34 and the second plate portion 35 is preferably set to 2.0 mm or less and, more preferably, to 0.8 mm or less.

Figure 6:
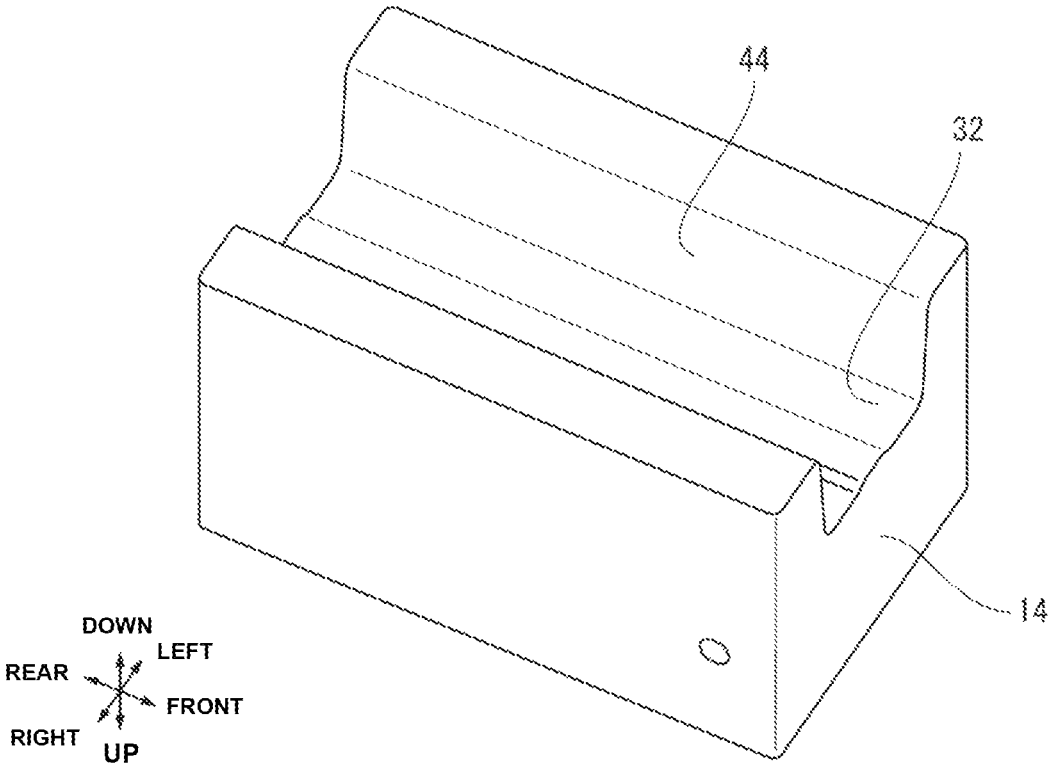
FIG. 6 is a perspective view showing an upper die from the lower die side.

As shown in FIG. 6, a forming surface 44 of the upper die 14 is formed on the surface of the concave portion 32 of the upper die 14. The forming surface 44 is formed into the same shape without unevenness in the front-and-rear direction of the upper die 14.

Figure 2:
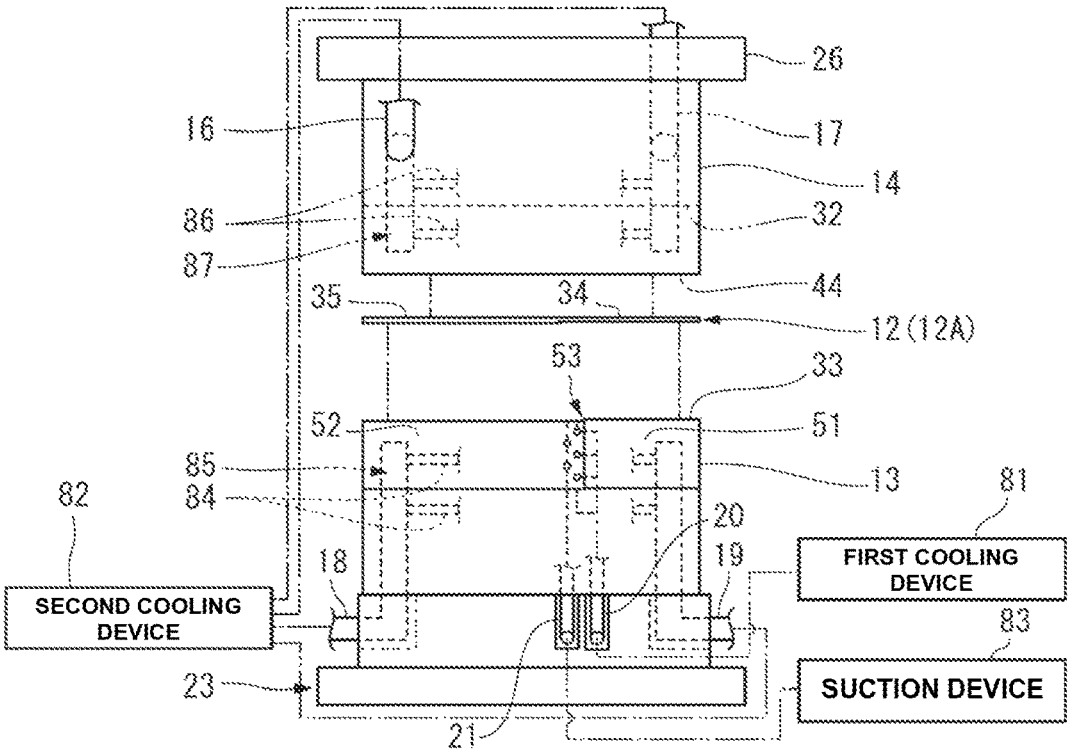
FIG. 2 is a side view showing the configuration of a die portion of the hot press forming apparatus.
Figure 4:
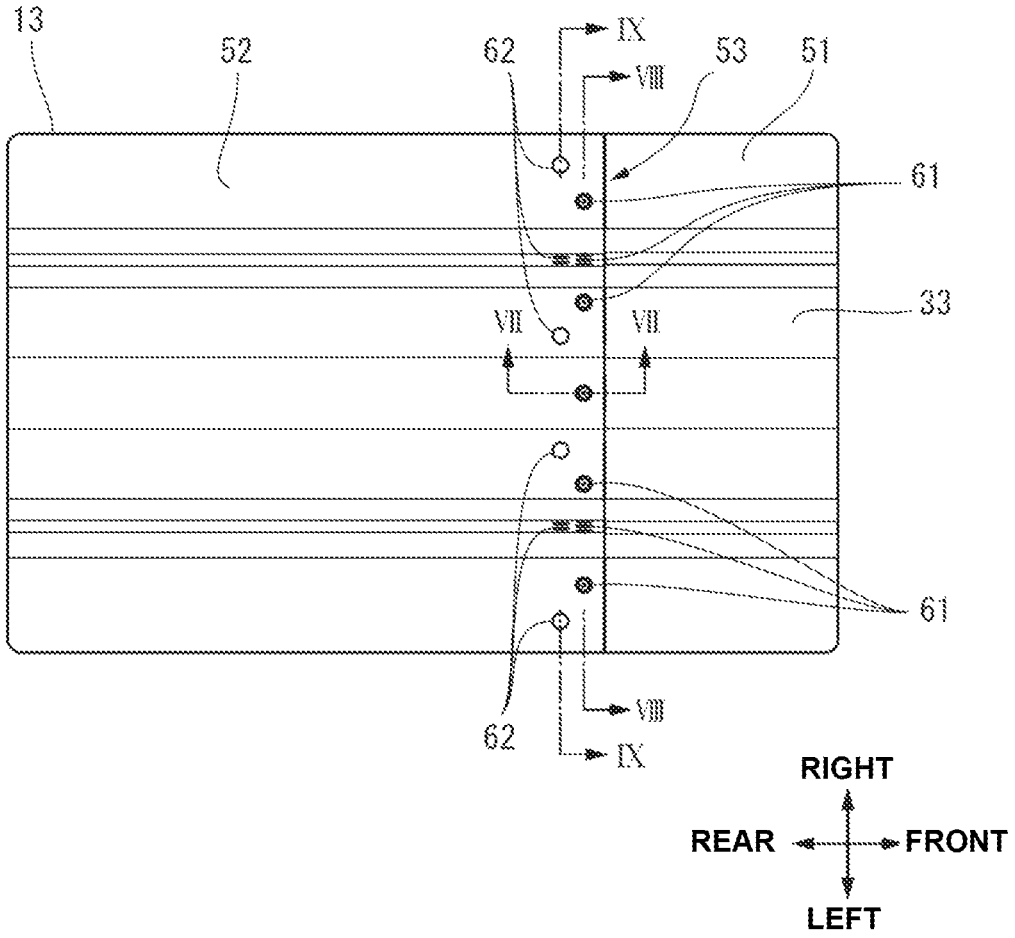
FIG. 4 is a plan view of a lower die according to the first embodiment.
Figure 5:
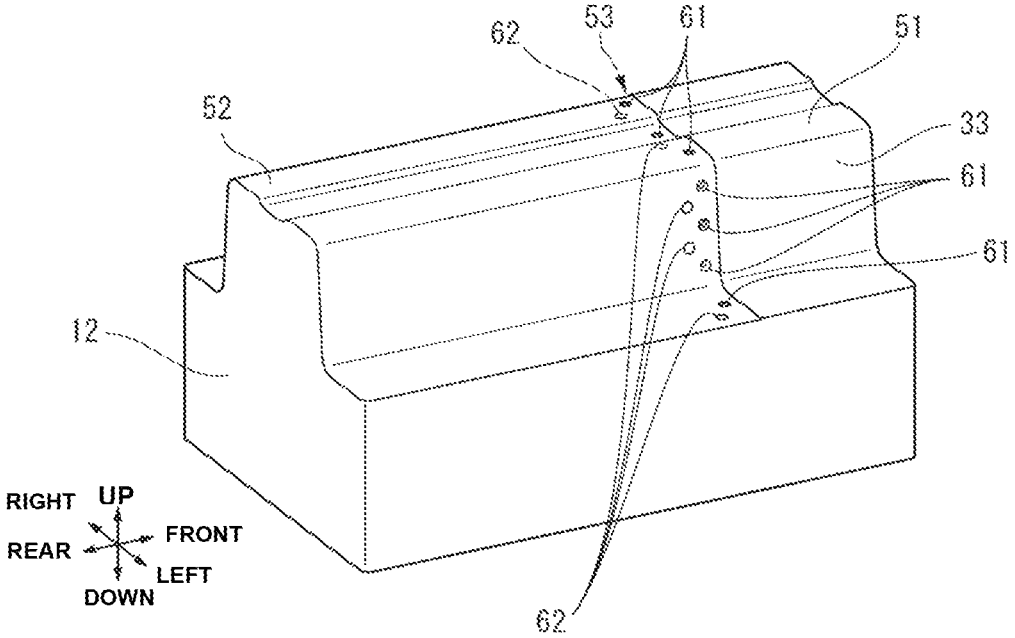
FIG. 5 is a perspective view showing the lower die from an upper die side.
Figure 7:
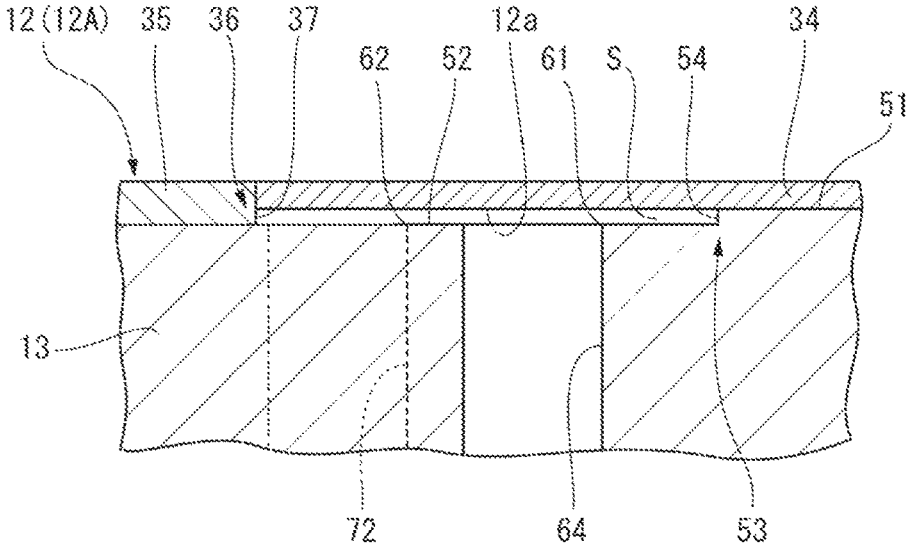
FIG. 7 is an enlarged sectional view showing the main part of the lower die and the tailor welded blank.

As shown in FIG. 2, the lower die 13 includes a first forming surface 51 that forms the first plate portion 34 of the metal plate material 12, and a second forming surface 52 that forms the second plate portion 35 of the metal plate material 12. The second forming surface 52 is farther apart from the forming surface 44 of the upper die 14 than the first forming surface 51 and forms a step 53 together with the first forming surface 51. The step 53 is formed to cross the lower die 13 in the left-and-right direction, as shown in FIG. 4. Also, the step 53 includes a second step surface 54 that rises in the thickness direction of the metal plate material 12, as shown in FIG. 7. FIG. 7 shows a state in which the metal plate material 12 is placed on the lower die 13 and positioned at the forming position. The cut position of FIG. 7 is a position indicated by a line VII-VII in FIG. 4.

The second step surface 54 rises from the second forming surface 52 in the thickness direction of the metal plate material 12 by a height corresponding to the difference between the thickness of the first plate portion 34 and the thickness of the second plate portion 35. In addition, the second step surface 54 is formed to be apart from the first step surface 37 to the front side by a predetermined distance when the metal plate material 12 is positioned on the lower die 13. Hence, a die releasing space S sandwiched between the first plate portion 34 and the second forming surface 52 is formed between the first step surface 37 and the second step surface 54. A part of the first plate portion 34 exposed to the die releasing space S will be referred to as a step portion 12*a* of the metal plate material 12 hereinafter.

The width of the die releasing space S (the interval between the first step surface 37 and the second step surface 54) is formed to be larger than the tolerance between the metal plate material 12 and the lower die 13.

Since the die releasing space S is thus formed, even if the first step surface 37 of the metal plate material 12 approaches the second step surface 54 of the lower die 13 within the range of the tolerance, the interval between the first step surface 37 and the second step surface 54 never becomes 0. For this reason, at the time of forming, the relatively high first forming surface 51 of the lower die 13 can be prevented from overlapping the relatively thick second plate portion 35 of the metal plate material 12 and causing a forming failure.

In the second forming surface 52 exposed to the die releasing space S, in other words, in a portion of the second forming surface 52 near the step 53 between the first forming surface 51 and the second forming surface 52, at least one ejection port 61 and at least one suction port 62 open. The ejection ports 61 and the suction ports 62 according to this embodiment are provided at a plurality of positions arranged along the step 53 formed by the first forming surface 51 and the second forming surface 52, as shown in FIG. 4. The ejection ports 61 and the suction ports 62 according to this embodiment are disposed to be apart from each other in the left-and-right direction and in the front-and-rear direction. Also, as shown in FIG. 7, the ejection ports 61 and the suction ports 62 are disposed at positions apart from the second plate portion 35 by a length obtained by adding a predetermined length to the tolerance of the second plate portion 35 in the manufacture.

Figure 8:
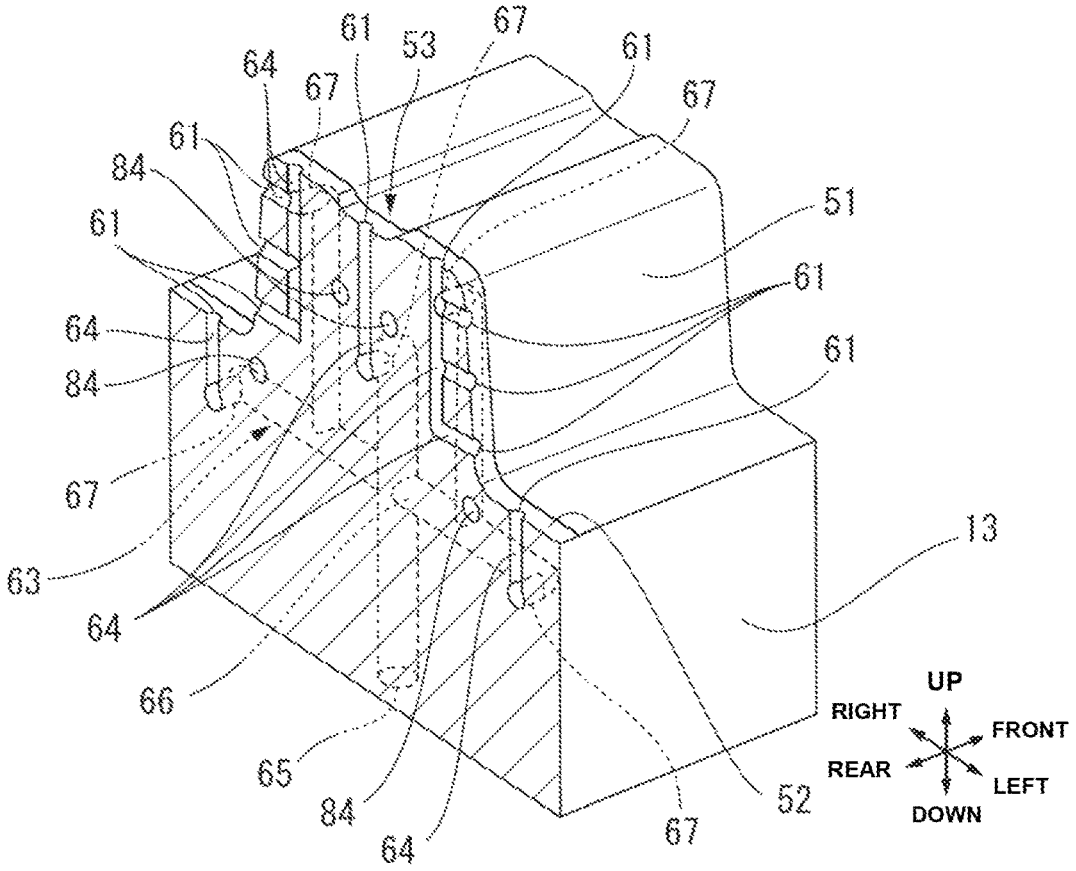
FIG. 8 is a partially cutaway perspective view of the lower die.

As shown in FIG. 8, the lower die 13 is provided with a refrigerant passage 63 for refrigerant distribution, and refrigerant ejection paths 64 each having one end connected to the refrigerant passage 63.

As shown in FIG. 8, each ejection port 61 is the other end of the refrigerant ejection path 64 formed for each ejection port 61. The refrigerant passage 63 for refrigerant distribution includes a refrigerant inlet 65 opening to the lower surface of the lower die 13. One end of the supply pipe 20 (see FIG. 1) is connected to the refrigerant inlet 65, and a refrigerant is supplied from the cooling unit 22 to be described later. FIG. 8 is a perspective view of the lower die 13 cut along a line VIII-VIII in FIG. 4. The refrigerant ejection paths 64 linearly extend from the ejection ports 61 into the lower die 13. The other end of each refrigerant ejection path 64 opens as the ejection port 61 in the second forming surface 52 near the step 53.

The refrigerant passage 63 is formed by a distribution portion 66 provided at the same position as the refrigerant inlet 65 in the front-and-rear direction, and a plurality of communicating portions 67 extending backward from the distribution portion 66. The distribution portion 66 extends from the refrigerant inlet 65 to a plurality of points in the vertical direction and a plurality of points in the left-and-right direction. The communicating portions 67 are connected to the plurality of distal end portions of the distribution portion 66. One-end sides of the refrigerant ejection paths 64 are connected to the communicating portions 67.

Figure 9:
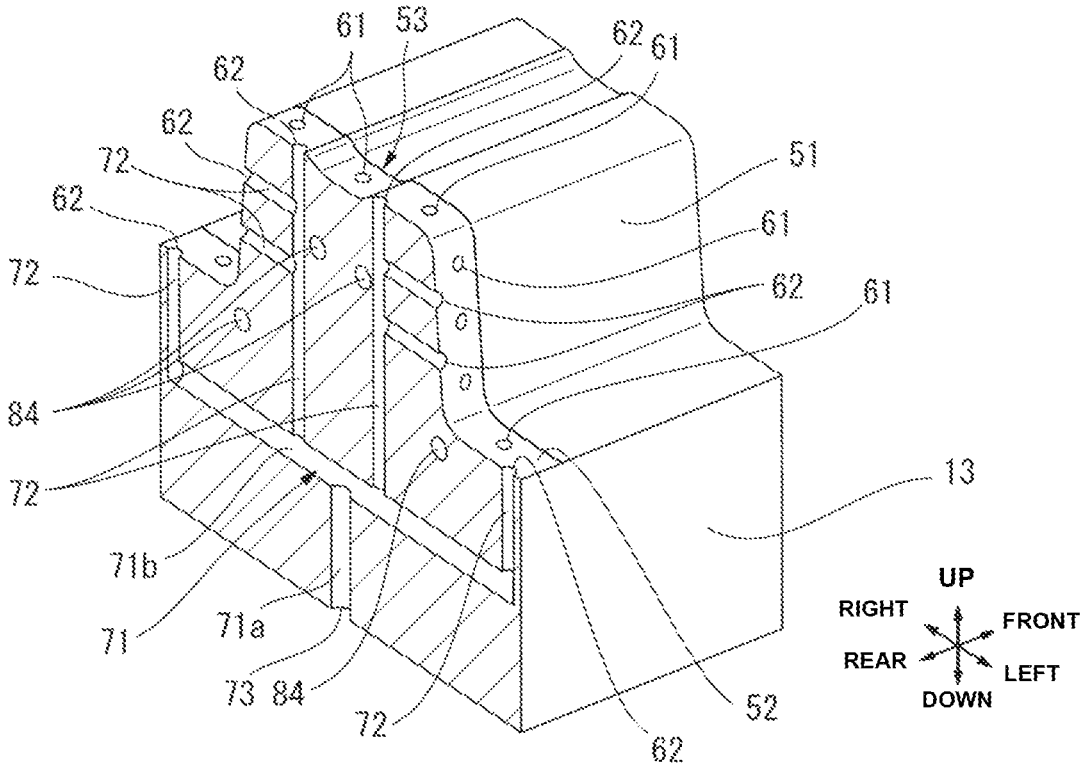
FIG. 9 is a partially cutaway perspective view of the lower die.

In addition, the lower die 13 is provided with a collection path 71 configured to collect the refrigerant, and suction paths 72 each having one end connected to the collection path 71, as shown in FIG. 9.

Each suction port 62 is the other end of the suction path 72 formed for each suction port 62. The collection path 71 includes a refrigerant outlet 73 opening to the lower surface of the lower die 13. One end of the suction pipe 21 (see FIG. 1) is connected to the refrigerant outlet 73, and a negative pressure is propagated from the cooling unit 22 to be described later. FIG. 9 is a perspective view of the lower die 13 cut along a line IX-IX in FIG. 4. The suction paths 72 linearly extend from the suction ports 62 into the lower die 13.

The collection path 71 is formed into a T shape by a vertical passage 71*a* extending upward from the refrigerant outlet 73, and a horizontal passage 71*b* extending from the upper end of the vertical passage 71*a* in the left-and-right direction. The suction paths 72 are connected to the horizontal passage 71*b* of the collection path 71.

Although details are not illustrated, these passages (the refrigerant passage 63, the refrigerant ejection paths 64, the collection path 71, and the suction paths 72) formed in the lower die 13 are formed by holes made by drilling in the lower die 13. The openings serving as the drill insertion ports for the refrigerant passage 63 and the collection path 71 are closed by plug members (not shown), except the refrigerant inlet 65 and the refrigerant outlet 73. In this embodiment, the lower die 13 corresponds to "a die to which a refrigerant is supplied" in the present invention.

As shown in FIG. 1, the cooling unit 22 includes a first cooling device 81, a second cooling device 82, and a suction device 83.

The first cooling device 81 supplies a liquid refrigerant to the supply pipe 20 such that the refrigerant is ejected from each ejection port 61 at the time of forming. As the liquid refrigerant, water, a cooling liquid containing a drug, or the like can be used. The first cooling device 81 has a function of cooling the refrigerant to a predetermined temperature in addition to a function of sending the refrigerant to the supply pipe 20 at the time of forming. In this embodiment, the first cooling device 81 corresponds to "a cooling device" in the present invention.

As shown in FIG. 2, the second cooling device 82 is connected to a circulating channel 85 of the lower die 13, which is formed by heat exchange passages 84, a sending-side pipe 18, and a return-side pipe 19 in the lower die 13, and a circulating channel 87 of the upper die 14, which is formed by heat exchange passages 86, a sending-side pipe 16, and a return-side pipe 17 in the upper die 14. As shown in FIGS. 8 and 9, the heat exchange passages 84 in the lower die 13 are formed at positions apart from the refrigerant supply passages (the refrigerant passage 63 and the refrigerant ejection paths 64) and the suction passages (the collection path 71 and the suction paths 72) in the vertical direction and in the left-and-right direction.

The second cooling device 82 has a function of passing the refrigerant through the circulating channel 85 of the lower die 13 and the circulating channel 87 of the upper die 14, and a function of cooling the refrigerant to a predetermined temperature. When the refrigerant of the predetermined temperature flows through the circulating channel 85 of the lower die 13, the lower die 13 is cooled by the refrigerant. In addition, when the refrigerant of the predetermined temperature flows through the circulating channel 87 of the upper die 14, the upper die 14 is cooled by the refrigerant.

The suction device 83 sucks the refrigerant from the suction pipe 21 of the lower die 13 and discharges it to a waste liquid tank (not shown).

To manufacture the formed product 31 from the metal plate material 12 using the thus configured hot press forming apparatus 11, first, the upper die 14 is positioned at the retreat position, as shown in FIG. 2, and the metal plate material 12 heated to a predetermined temperature is inserted between the upper die 14 and the lower die 13. Then, as shown in FIG. 1, the upper die 14 is lowered to form the metal plate material 12 by the upper die 14 and the lower die 13. At this time, since the lower die 13 and the upper die 14 are cooled by the refrigerant, the metal plate material 12 is quickly cooled and quenched at the same time as the forming. Also, at the time of forming, since the first cooling device 81 supplies the refrigerant to the supply pipe 20, the refrigerant is ejected from the ejection ports 61 of the lower die 13. The refrigerant fills the die releasing space S and cools the step portion 12*a* of the metal plate material 12 exposed to the die releasing space S.

As a result, when press-forming the heated metal plate material 12, quenching is performed for the step portion 12*a* of the metal plate material 12 as well. Hence, according to this embodiment, it is possible to provide a die for hot press forming, which can perform quenching even for the step portion 12*a* of the metal plate material 12 and increase hardness, and a hot press forming apparatus.

Figure 10:
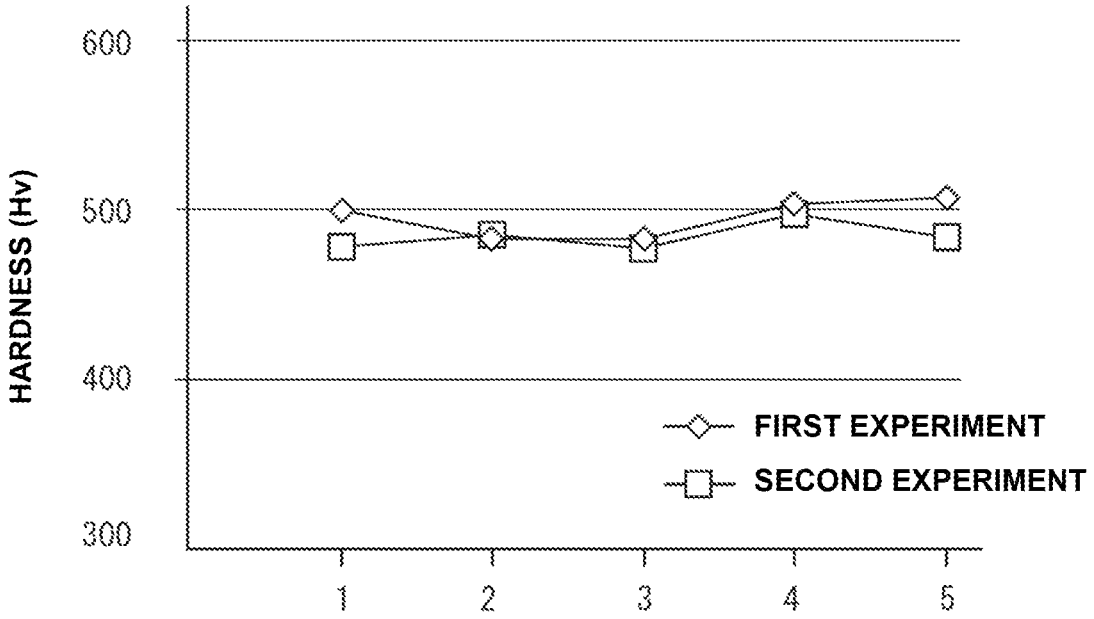
FIG. 10 is a graph showing the result of experiments for examining the present invention.

When prototypes of the pair of dies 13 and 14 according to this embodiment were made, and experiments were conducted, a result as shown in FIG. 10 was obtained. The thickness of the first plate portion 34 of the metal plate material 12 used for the experiments was 1.2 mm, and the thickness of the second plate portion 35 was 1.6 mm. The hardness of a portion of the first plate portion 34 exposed to the die releasing space S was measured. The reference value of the hardness was 400 Hv. The experiments were performed for two metal plate materials 12. The measurement of hardness was performed, for each metal plate material 12, at five longitudinal-direction points of the die releasing space S extending in the left-and-right direction of the die.

According to the experiments, it is found that the hardness greatly exceeds the reference value, and the hardness is stable in each metal plate material 12.

In this embodiment, the plurality of suction ports 62 open near the ejection ports 61 (the openings on the other-end sides of the refrigerant ejection paths 64). For this reason, the refrigerant that hits the first plate portion 34 in the die releasing space S and returns, that is, the refrigerant whose temperature has risen can be sucked from the suction ports 62. Hence, since the first plate portion 34 can always be cooled by the refrigerant at the low temperature, the cooling efficiency is high, and quenching can sufficiently be performed.

The ejection ports 61 and the suction ports 62 according to this embodiment are provided at the plurality of positions arranged along the step 53 formed by the first forming surface 51 and the second forming surface 52. Hence, since the refrigerant can be supplied all over the die releasing space S, quenching can evenly be performed all over the step portion 12*a* of the metal plate material 12, and the formed product 31 of high quality can be formed.

Second Embodiment

Figure 11:
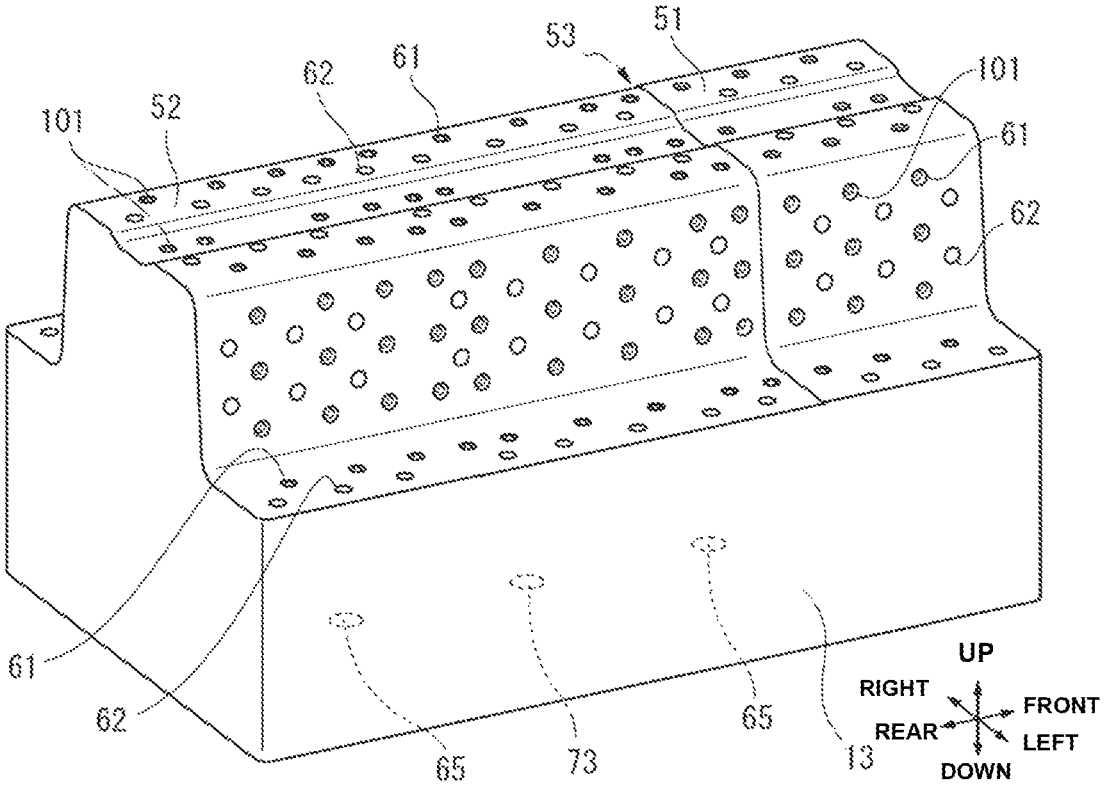
FIG. 11 is a perspective view of a lower die according to the second embodiment.
Figure 12:
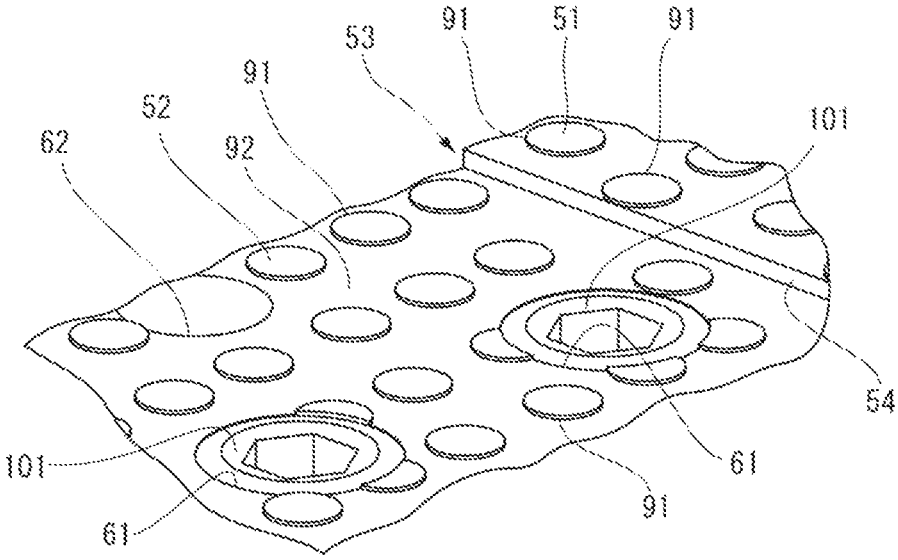
FIG. 12 is an enlarged perspective view showing a part of the forming surface of the lower die.
Figure 13:
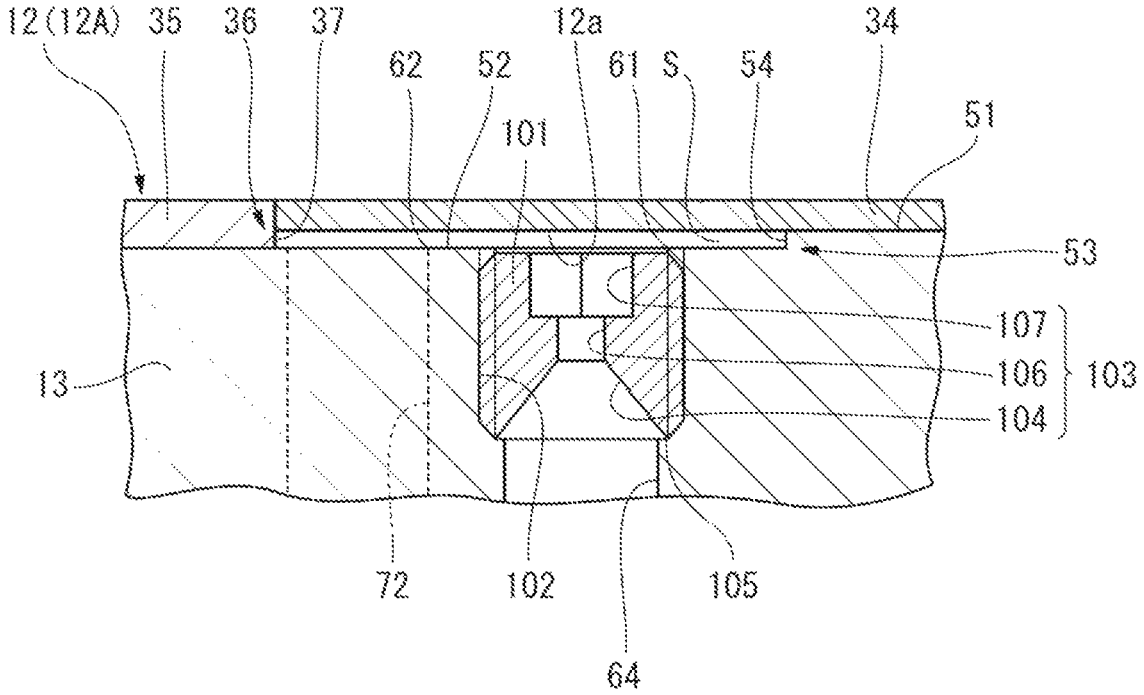
FIG. 13 is a sectional view showing a modification of the ejection port of the main part of the lower die.

A first forming surface 51 and a second forming surface 52 of a lower die 13 can be formed as shown in FIGS. 11 to 13. The same reference numerals as in FIGS. 1 to 9 denote similar or same members in these drawings, and a detailed description thereof will appropriately be omitted.

Many ejection ports 61 and many suction ports 62 are formed in the first forming surface 51 and the second forming surface 52 of the lower die 13 shown in FIG. 11. The ejection ports 61 and the suction ports 62 shown in FIG. 11 are provided at positions apart at a predetermined interval in the front-and-rear direction of the lower die 13 such that these are apart from each other, and are provided all over the first forming surface 51 and the second forming surface 52. Note that instead of providing the ejection ports 61 and the suction ports 62 all over the first forming surface 51 and the second forming surface 52, these can be formed only in portions of the first forming surface 51 and the second forming surface 52 where the cooling performance needs to be particularly high. That is, the ejection ports 61 and the suction ports 62 are formed in at least parts of the first forming surface 51 and the second forming surface 52.

The ejection ports 61 are formed on the other-end sides of refrigerant ejection paths (not shown) that are the same as refrigerant ejection paths 64 shown in FIG. 8. The refrigerant ejection paths are provided to be arranged in the front-and-rear direction at the formation pitch of the ejection ports 61 in the front-and-rear direction of the lower die 13. The refrigerant ejection paths are connected to communicating paths (not shown) formed by extending communicating portions 67 shown in FIG. 8 in the front-and-rear direction. Also, the communicating paths are connected to two refrigerant inlets 65 on the lower surface of the lower die 13 by a distribution path (not shown) having the same shape as a distribution portion 66 shown in FIG. 8. The two refrigerant inlets 65 are each connected to a first cooling device 81 (see FIG. 2) by a supply pipe 20. Of the two refrigerant inlets 65, the refrigerant inlet 65 located on the front side of the lower die 13 is connected to many ejection ports 61 provided in the front half of the lower die 13. The refrigerant inlet 65 located on the rear side of the lower die 13 is connected to many ejection ports 61 provided in the rear half of the lower die 13.

The plurality of suction ports 62 are formed on the other-end sides of suction paths (not shown) that are the same as suction paths 72 shown in FIG. 9. The suction paths are provided to be arranged in the front-and-rear direction at the formation pitch of the suction ports 62 in the front-and-rear direction of the lower die 13. The suction paths are connected to a plurality of communicating paths extending in the front-and-rear direction of the lower die 13. The plurality of communicating paths are connected to a refrigerant outlet 73 on the lower surface of the lower die 13 by a collection path (not shown) that is the same as a collection path 71 shown in FIG. 9. The refrigerant outlet 73 is connected to a suction device 83 (see FIG. 2) by a suction pipe 21.

When viewed in an enlarged state, the first forming surface 51 and the second forming surface 52 shown in FIG. 11 are formed by a lot of convex portions 91, as shown in FIG. 12. The convex portions 91 are each formed into a columnar shape or a truncated conical shape. The distal end faces of the convex portions 91 substantially function as the first forming surface 51 or the second forming surface 52. A plane surface 92 along the first forming surface 51 and the second forming surface 52 is formed among the convex portions 91. The plane surface 92 is apart from a metal plate material 12 at the time of forming. For this reason, on the lower die 13, a gap is formed between the metal plate material 12 and the plane surface 92 at the time of forming. A refrigerant is supplied from the ejection ports 61 to the gap at the time of forming. The refrigerant wetly spreads wide on the lower surface of the metal plate material 12 to cool the metal plate material 12. The refrigerant that has taken the heat of the metal plate material 12 and increased its temperature is sucked to the suction ports 62 and discharged from the lower die 13.

For this reason, a large amount of refrigerant supplied to a die releasing space S is discharged from the die releasing space S to the side of the first forming surface 51 or the side of the second forming surface 52 without any delays, the die releasing space S is always filled with the refrigerant at a low temperature, and the cooling efficiency improves. On the other hand, if the amount of refrigerant supplied to the die releasing space S is smaller than on the periphery, the refrigerant is replenished into the die releasing space S from the side of the first forming surface 51 and the side of the second forming surface 52, and the amount of refrigerant supplied to the die releasing space S can be increased.

When the efficiency of cooling by the refrigerant improves, or the amount of refrigerant increases, quenching for a step portion 12*a* of the metal plate material 12 can more reliably be performed.

If many convex portions 91 are formed on the first forming surface 51 and the second forming surface 52, as shown in FIG. 13, nozzles 101 can be provided on the refrigerant ejection paths 64 connected to the ejection ports 61. FIG. 13 shows an example in which the nozzle 101 is attached to the refrigerant ejection path 64 opening to the die releasing space S. However, the nozzles 101 can be attached to all refrigerant ejection paths 64 of the lower die 13.

The downstream portion (other-end side) of the refrigerant ejection path 64 including the ejection port 61 shown in FIG. 13 is formed by a screw hole 102.

The nozzle 101 includes an ejection passage 103 from which the refrigerant is ejected, and is screwed into the screw hole 102. The ejection passage 103 includes three functional portions. The first functional portion is a tapered portion 104 that forms the upstream-side end portion of the ejection passage 103. The tapered portion 104 is formed into a tapered shape whose hole diameter gradually becomes small from an opening 105 located at the upstream end of the nozzle 101 to the downstream side. The opening 105 at the upstream end of the nozzle 101 is larger than the inner diameter of the refrigerant ejection path 64 connected to the screw hole 102.

The second functional portion is a passage hole 106 located at the center of the nozzle 101 in the axial direction. The passage hole 106 connects the downstream end of the tapered portion 104 and a hexagonal hole 107 that is the third functional portion to be described later. The passage hole 106 has a circular shape. The hole diameter of the passage hole 106 is constant from the upstream end to the downstream end. The hole diameter is associated with the amount of refrigerant that passes through the nozzle 101. If the hole diameter of the passage hole 106 becomes large, the amount of refrigerant that passes through the nozzle 101 increases. On the other hand, if the hole diameter of the passage hole 106 becomes small, the amount of refrigerant that passes through the nozzle 101 decreases.

The passage hole 106 needs to have a length to some extent to obtain an effect of adjusting the flowing direction of the refrigerant. The length of the passage hole 106 according to this embodiment is the same as the hole diameter. Note that the length of the passage hole 106 may be larger than the hole diameter. The length of the passage hole 106 according to this embodiment is shorter than the length of the tapered portion 104 in the axial direction.

If this embodiment is employed, a plurality of types of nozzles 101 including the passage holes 106 of different hole diameters are formed in advance. Nozzles having such a hole diameter that the amount of refrigerant ejected from the refrigerant ejection path 64 satisfies a target amount are selected and attached to the refrigerant ejection paths 64 as the nozzles 101.

The third functional portion is the hexagonal hole 107 serving as an opening on the downstream side of the ejection passage 103. The hexagonal hole 107 is formed into a shape in which a hexagonal wrench (not shown) is fitted. A work of screwing the nozzle 101 into the screw hole 102 or a work of detaching the nozzle 101 from the screw hole 102 is performed by rotating the hexagonal wrench fitted in the hexagonal hole 107.

According to this embodiment, the nozzle 101 in which the flow amount of refrigerant is relatively large is attached to each ejection port 61 that ejects the refrigerant to the die releasing space S, thereby more efficiently cooling the step portion 12*a* of the metal plate material 12.

Third Embodiment

A die according to the present invention can form metal plate materials as shown in FIGS. 14 to 17. The same reference numerals as in FIGS. 1 to 13 denote similar or same members in FIGS. 14 to 17, and a detailed description thereof will appropriately be omitted.

A metal plate material 12 shown in each of FIGS. 14 to 17 is a tailor welded blank 12B including a third plate portion 111 between a first plate portion 34 and a second plate portion 35.

The third plate portion 111 is formed by a third metal plate material welded between a first metal plate material that forms the first plate portion 34 and a second metal plate material that forms the second plate portion 35. One end of the third plate portion 111 is welded while making it abut against the first plate portion 34, and the other end of the third plate portion 111 is welded while making it abut against the second plate portion 35.

A die releasing space S generated by overlaying the tailor welded blank 12B shown in each of FIGS. 14 to 17 on a lower die 13 is formed while being sandwiched by the first plate portion 34, the third plate portion 111, and a second forming surface 52.

Figure 14:
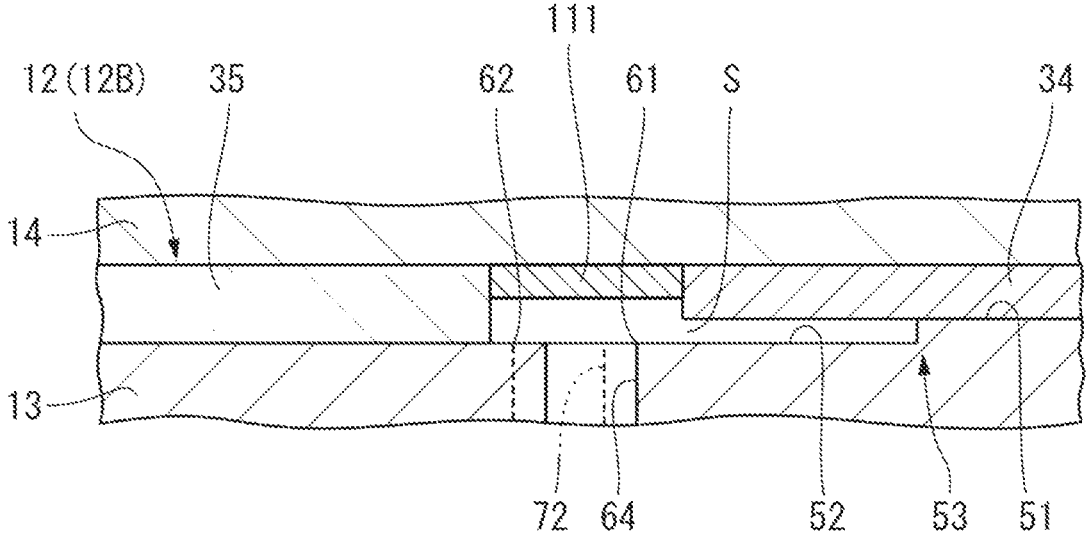
FIG. 14 is a sectional view for explaining a modification of the tailor welded blank.

The third plate portion 111 shown in FIG. 14 has a constant thickness from one end to the other end and is formed to be thinner than the first plate portion 34.

Figure 15:
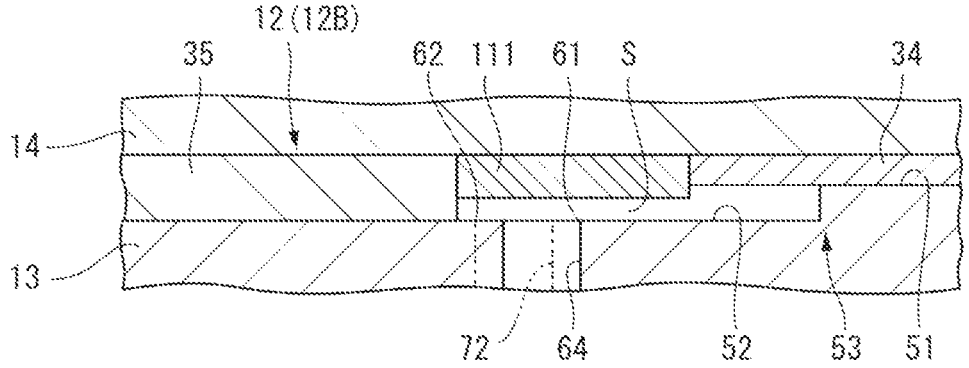
FIG. 15 is a sectional view for explaining a modification of the tailor welded blank.

The third plate portion 111 shown in FIG. 15 has a constant thickness from one end to the other end and is formed to be thicker than the first plate portion 34 and thinner than the second plate portion 35.

Figure 16:
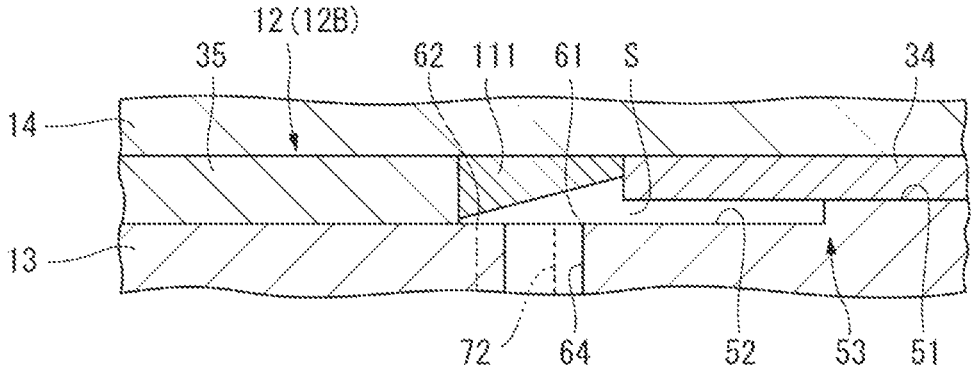
FIG. 16 is a sectional view for explaining a modification of the tailor welded blank.

The third plate portion 111 shown in FIG. 16 is formed such that one end welded to the first plate portion 34 becomes thinner than the first plate portion 34, and the other end welded to the second plate portion 35 becomes slightly thinner than the second plate portion 35, and is also formed to gradually increase the thickness from one end to the other end.

Figure 17:
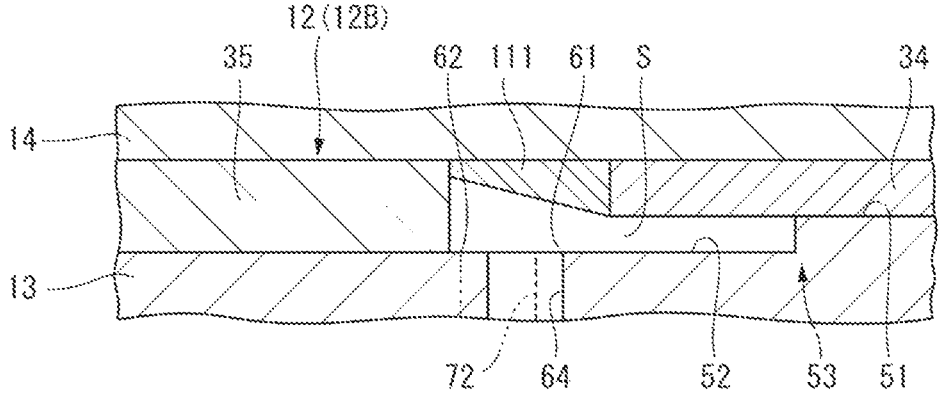
FIG. 17 is a sectional view for explaining a modification of the tailor welded blank.

The third plate portion 111 shown in FIG. 17 is formed such that one end welded to the first plate portion 34 has the same thickness as the first plate portion 34, and the other end welded to the second plate portion 35 becomes thinner than the first plate portion 34, and is also formed to gradually decrease the thickness from one end to the other end.

Fourth Embodiment

A die according to the present invention can form metal plate materials as shown in FIGS. 18A to 20B. The same reference numerals as in FIGS. 1 to 13 denote similar or same members in FIGS. 18A to 20B, and a detailed description thereof will appropriately be omitted.

Figure 18A:
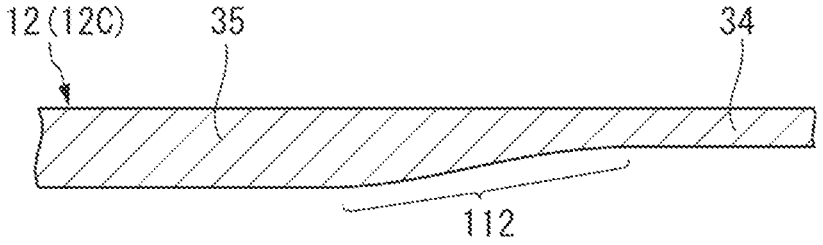
FIG. 18A is a sectional view for explaining a form of use of a tailor rolled blank.
Figure 18B:
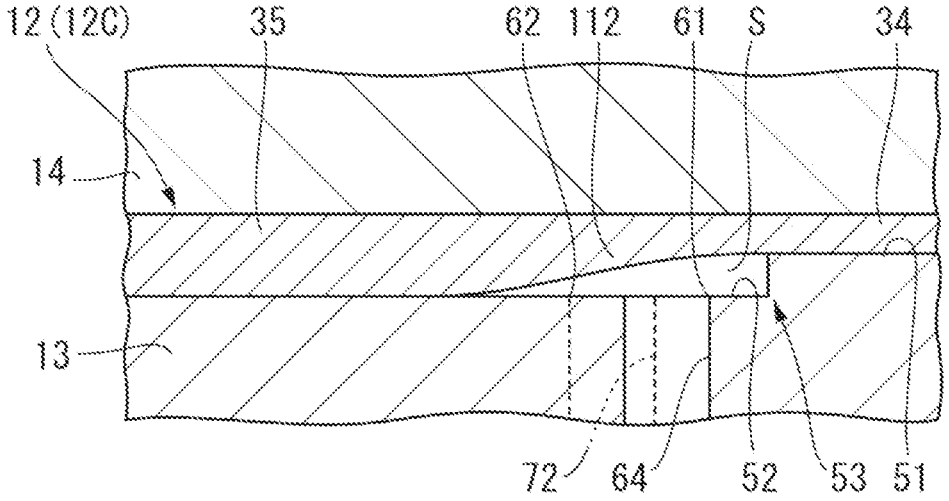
FIG. 18B is a sectional view for explaining a form of use of a tailor rolled blank.
Figure 19A:
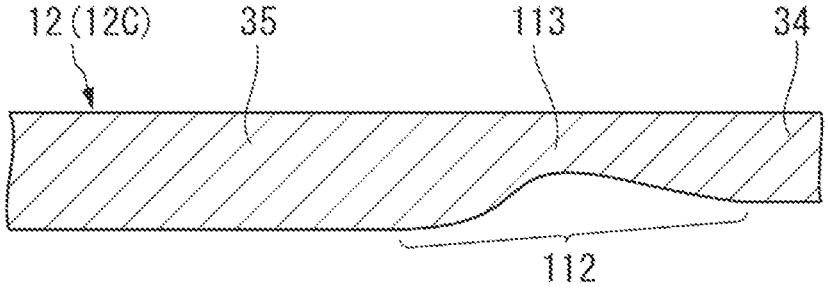
FIG. 19A is a sectional view for explaining a form of use of a tailor rolled blank.
Figure 19B:
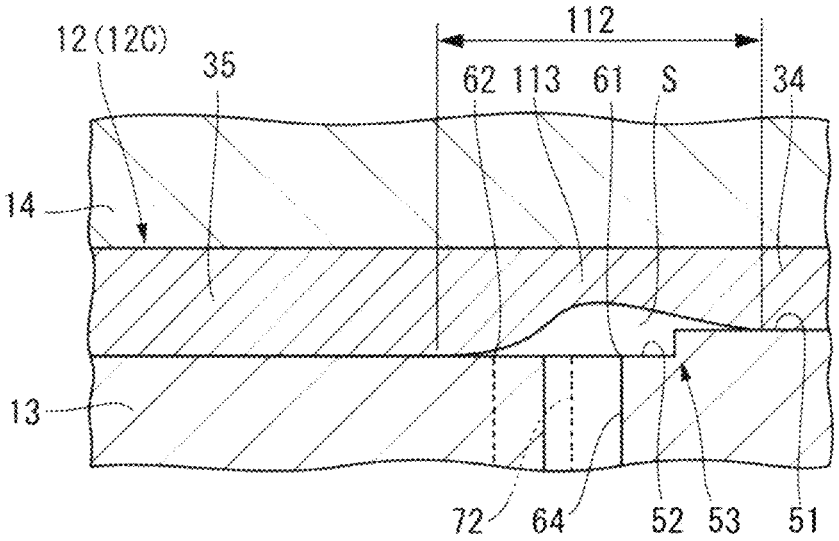
FIG. 19B is a sectional view for explaining a form of use of a tailor rolled blank.
Figure 20A:
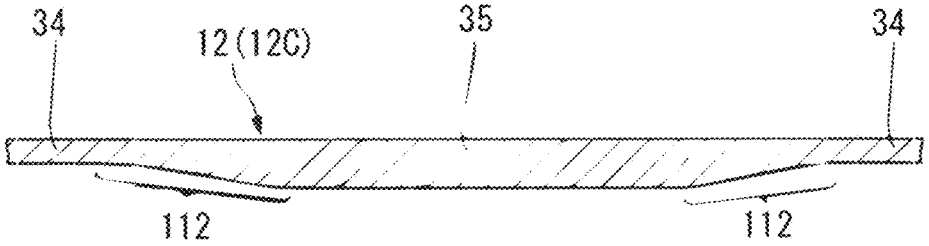
FIG. 20A is a sectional view for explaining a form of use of a tailor rolled blank.
Figure 20B:
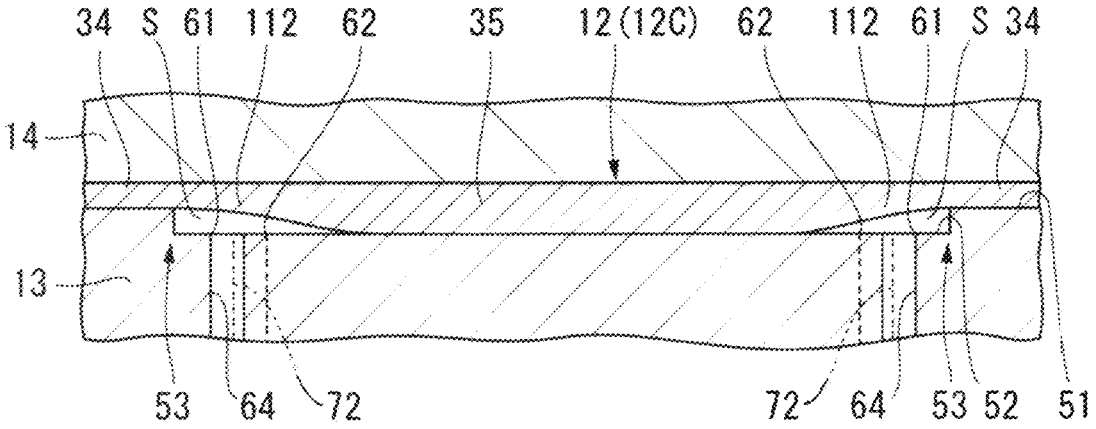
FIG. 20B is a sectional view for explaining a form of use of a tailor rolled blank.

A metal plate material 12 shown in each of FIGS. 18A to 20B is called a tailor rolled blank, and a first plate portion 34 and a second plate portion 35 thicker than the first plate portion 34 are integrally formed. In FIGS. 18A to 20B, the tailor rolled blank is denoted by reference numeral 12C. FIGS. 18A, 19A, and 20A are sectional views each showing a step portion where the thickness of the tailor welded blank 12C changes, and FIGS. 18B, 19B, and 20B are sectional views each showing a state in which the tailor welded blank 12C is sandwiched between a lower die 13 and an upper die 14.

The tailor welded blank 12C shown in FIG. 18A includes a step portion 112 whose thickness gradually changes in a portion serving as the boundary between the first plate portion 34 and the second plate portion 35. A die releasing space S generated by overlaying the tailor welded blank 12C shown in FIG. 18A on the lower die 13 is formed while being sandwiched by the first plate portion 34, the step portion 112, and a second forming surface 52, as shown in FIG. 18B.

The tailor welded blank 12C shown in FIG. 19A includes a third plate portion 113 thinner than the first plate portion 34 between the first plate portion 34 and the second plate portion 35. That is, the third plate portion 113 that is partially thin is formed in the step portion 112 between the first plate portion 34 and the second plate portion 35.

The die releasing space S generated by overlaying the tailor welded blank 12C shown in FIG. 19A on the lower die 13 is formed while being sandwiched by the step portion 112 including the third plate portion 113 and the second forming surface 52, as shown in FIG. 19B.

The tailor welded blank 12C shown in FIG. 20A includes the first plate portions 34 on both sides of the second plate portion 35. That is, the step portion 112 whose thickness gradually changes is formed in a portion serving as the boundary between the second plate portion 35 and each first plate portion 34. On the lower die 13 that forms the tailor welded blank 12C shown in FIG. 20A, first forming surfaces 51 are provided on both sides of the second forming surface 52. In this case, the die releasing space S is formed while being sandwiched by the first plate portions 34 and the step portions 112 located on both sides of the second plate portion 35, and the second forming surface 52, as shown in FIG. 20B.

Fifth Embodiment

Figure 21A:
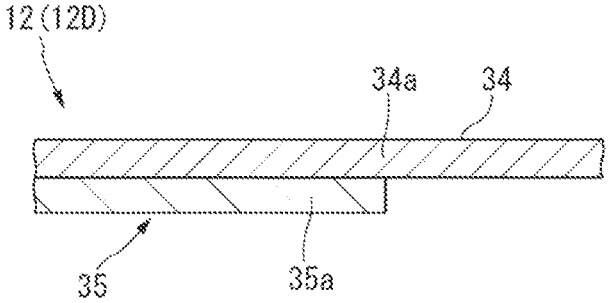
FIG. 21A is a sectional view for explaining a form of use of a patched blank.
Figure 21B:
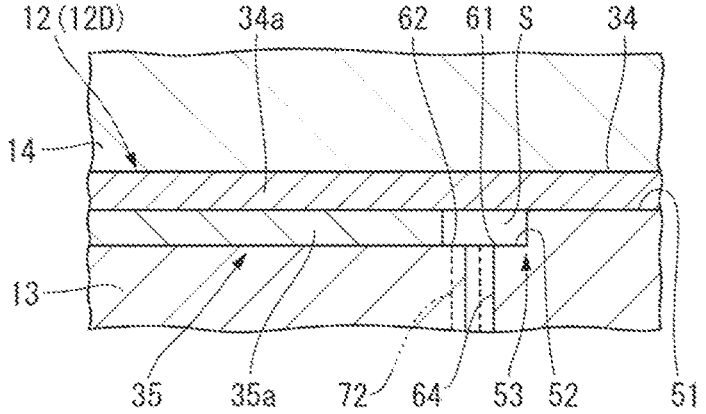
FIG. 21B is a sectional view for explaining a form of use of a patched blank.
Figure 22:
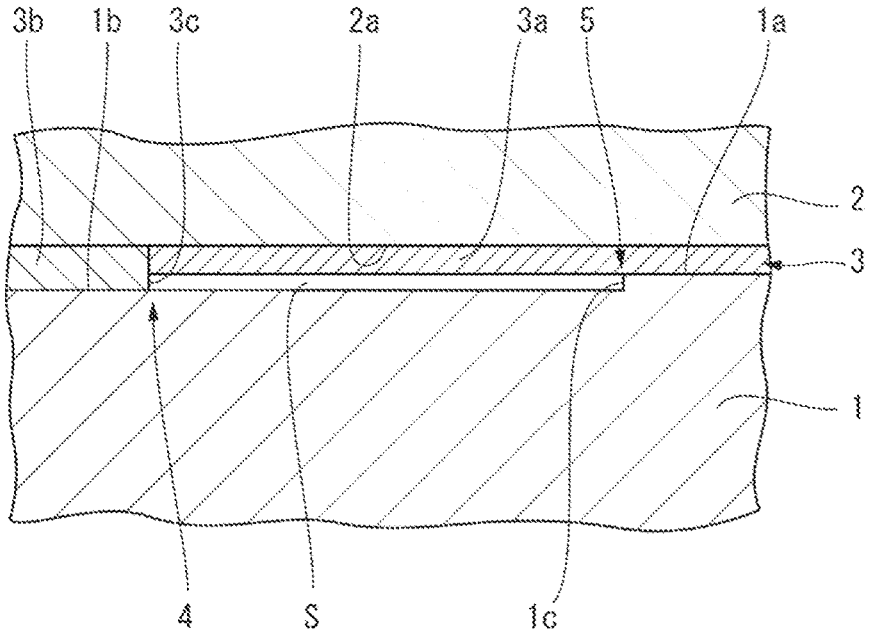
FIG. 22 is a sectional view showing a part of a conventional die for hot press forming and a metal plate material.

A die according to the present invention can form a metal plate material as shown in FIGS. 21A and 21B. The same reference numerals as in FIGS. 1 to 13 denote similar or same members in FIGS. 21A and 21B, and a detailed description thereof will appropriately be omitted.

A metal plate material 12 shown in FIGS. 21A and 21B is called a patched blank, and includes a first plate portion 34 formed by only one metal plate material, and a second plate portion 35 formed by two metal plate materials. In FIGS. 21A and 21B, the patched blank is denoted by reference numeral 12D.

The second plate portion 35 is formed by overlaying and welding, on a first metal plate material 34*a* that forms the first plate portion 34, a second metal plate material 35*a* different from the first metal plate material 34*a*. The first metal plate material 34*a* and the second metal plate material 35*a* shown in FIG. 21A have the same thickness. However, the die according to the present invention can use the patched blank 12D formed by two metal plate materials having different thicknesses, although not illustrated.

A die releasing space S generated by overlaying the patched blank 12D on a lower die 13 is formed while being sandwiched by the first plate portion 34 and a second forming surface 52, as shown in FIG. 21B.

In the above-described embodiments, an example in which the ejection ports 61 are formed in the lower die 13 has been described. However, the present invention is not limited to this. If the step 36 is formed on the upper surface of the metal plate material 12, the step 53 is formed on the upper die 14, and the ejection ports 61 and the suction ports 62 are formed such that the die releasing space S is formed between the upper die 14 and the metal plate material 12. Also, if the step 36 is formed on each of the upper surface and the lower surface of the metal plate material 12, the ejection ports 61 are formed in each of the lower die 13 and the upper die 14.

Also, in the above-described embodiments, an example in which the plurality of suction ports 62 are provided has been described. However, the suction ports 62 may not be provided, or only one suction port 62 may be provided at a position corresponding to the die releasing space S.

Additionally, in the above-described embodiments, an example in which the formed product 31 has a so-called hat-shaped cross section has been described. However, the present invention is not limited to this, and can be applied to a die that forms a formed product of another shape.

EXPLANATION OF THE REFERENCE NUMERALS AND SIGNS

11 . . . hot press forming apparatus, 12 . . . metal plate material, 12A, 12B . . . tailor welded blank, 12C . . . tailor welded blank, 12D . . . patched blank, 13 . . . lower die, 14 . . . upper die, 51 . . . first forming surface, 52 . . . second forming surface, 53 . . . step, 61 . . . ejection port, 62 . . . suction port, 63 . . . refrigerant passage, 64 . . . refrigerant ejection path, 81 . . . first cooling device (cooling device), 83 . . . suction device, 91 . . . convex portion, 111, 113 . . . third plate portion.

The invention claimed is:

1. A die for press-forming a blank in a heated state, the die comprising:

a first forming surface and a second forming surface, the first forming surface being relatively higher than the second forming surface to form a die step therebetween;

a refrigerant passage through which a refrigerant flows;

a plurality of refrigerant ejection paths, each having one end connected to the refrigerant passage and the other end opening to the second forming surface such that a plurality of ejection ports of the refrigerant are provided on the second forming surface;

a plurality of suction ports provided on the second forming surface and configured to suck the refrigerant ejected from the plurality of ejection ports, and a plurality of convex portions formed on at least a part of the second forming surface, wherein the plurality of ejection ports and the plurality of suction ports are arranged in the part of the second forming surface along the die step, at least one of the plurality of suction ports is provided in the part of the second forming surface where the plurality of convex portions are provided.

2. The die according to claim 1, wherein at least one of the plurality of ejection ports is provided in the part of the second forming surface where the plurality convex portions are provided.

3. The die according to claim 2, further comprising:

a plurality of refrigerant ejection paths, each having one end connected to the refrigerant passage and the other end opening to the first forming surface such that a plurality of ejection ports of the refrigerant are provided on the first forming surface;

a plurality of suction ports provided on the first forming surface and configured to suck the refrigerant ejected from the plurality of ejection ports provided on the first forming surface; and a plurality of convex portions formed on at least a part of the first forming surface, wherein at least one of the plurality of ejection ports provided on the first forming surface and at least one of the plurality of suction ports provided on the first forming surface are provided in the part of the first forming surface where the plurality of convex portions are provided.

4. The die according to claim 1, wherein at least one of the plurality of suction ports is provided near one of the plurality of ejection ports.

* * * * *